US006578779B2

(12) United States Patent
Dion

(10) Patent No.: US 6,578,779 B2
(45) Date of Patent: Jun. 17, 2003

(54) ROTARY ATOMIZER WITH BELL ELEMENT

(75) Inventor: Mark E. Dion, St. Clair Shores, MI (US)

(73) Assignee: Behr Systems, Inc., Auburn Hills, MI (US)

( * ) Notice: Subject to any disclaimer, the term of this patent is extended or adjusted under 35 U.S.C. 154(b) by 81 days.

(21) Appl. No.: 09/874,595

(22) Filed: Jun. 5, 2001

(65) Prior Publication Data

US 2002/0043576 A1 Apr. 18, 2002

Related U.S. Application Data

(60) Provisional application No. 60/241,499, filed on Oct. 18, 2000.

(51) Int. Cl.[7] ..... B05B 5/00; F23D 11/32

(52) U.S. Cl. ..... 239/700; 239/703; 239/706; 239/690; 239/690.1

(58) Field of Search ..... 239/700, 703, 239/706, 223, 224, 690, 690.1, 697, 698, 701, 707, 3

(56) References Cited

U.S. PATENT DOCUMENTS 4,576,827 A * 3/1986 Hastings et al. ..... 427/27
5,011,086 A * 4/1991 Sonnleitner et al. ..... 239/691
5,346,139 A * 9/1994 Davis et al. ..... 239/703
5,358,182 A 10/1994 Cappeau et al.
5,707,009 A 1/1998 Schneider
6,056,215 A * 5/2000 Hansinger et al. ..... 239/703
6,189,804 B1 2/2001 Vetter et al.

FOREIGN PATENT DOCUMENTS

| | | |
|---|---|---|
| DE | 3241504 | 4/1984 |
| EP | 1038587 | 9/2000 |

OTHER PUBLICATIONS

Publication No. WO 99/49982; International Publication Date Oct. 7, 1999; PCT/FR99/00752; Search Report Jun. 14, 1999.

* cited by examiner

*Primary Examiner*—Davis Hwu
(74) *Attorney, Agent, or Firm*—Howard & Howard

(57) ABSTRACT

A rotary atomizer including a bell element having a paint tube, a deflector having a conical distribution surface opposite the paint tube outlet, including a tip portion within the paint tube, directing paint to a paint overflow surface through an annular conical channel adjacent the outer edge of a nonconductive end face, an annular electrostatically charged surface surrounding the outer edge of the end face generating an annular electrostatic field and an axial electrode having a sharp distal end in the plane of the annular electrostatically charged surface generating a second axial electrostatic field.

26 Claims, 3 Drawing Sheets

ROTARY ATOMIZER WITH BELL ELEMENT

RELATED APPLICATION

This application claims priority under 35 U.S.C. §1.9 (e) to U.S. provisional patent application Serial No. 60/241,499 filed Oct. 18, 2000.

FIELD OF THE INVENTION

The present invention relates to a rotary atomizer including a bell element for application of powder paint in mass production applications.

BACKGROUND OF THE INVENTION

Powder paint, including primer or basecoat and color coats have been used or proposed in mass production applications, including automotive applications, to reduce volatile organic compounds, such as solvents used in or in connection with liquid paint. Such powder paint is typically applied in mass production applications by a rotary atomizer having a rotary bell element, generally referred to in the industry as a "bell cup." A conventional bell element includes a paint tube, which receives the liquid or powder paint and which may be threadably attached to the bearing of the atomizer, a deflector or diverter element having a distribution surface opposed to the outlet of the paint tube which directs the paint radially and axially to an overflow surface. The bell element is rotated by the atomizer at a relatively high velocity, typically about 5,000 to 15,000 RPM, which "atomizes" the stream of paint by centrifugal force and directs the paint to the workpiece, such as an automotive body. Shaping air may also be used to improve the deposition efficiency of the paint on the workpiece.

To further improve the deposition efficiency of a rotary atomizer, the paint is electrostatically charged by the rotary atomizer and the workpiece is grounded which reduces paint overspray. One method of electrostatically charging paint, typically used for liquid paint, is the use of a charge ring or "halo" surrounding the bell element having a plurality of axially extending electrodes. Another method is to electrostatically charge a component or components of the bell element which contact the paint and which thereby imparts an electrostatic charge to the atomized paint. For example, U.S. Pat. No. 5,358,182 which discloses an electrostatic sprayer device for liquid coating which includes an elongated central counter-electrode at ground potential which "deforms" the electrostatic field near the atomizer edge or overflow surface to increase the time the liquid coating product droplets pass through a high electric field. Another example is disclosed in a PCT published application WO 99/49982, wherein the bell is electrically connected to a plurality of Corona discharge elements and a generator capable of detecting variations in the current passing through the discharge elements.

Although the use of powder paint reduces or eliminates volatile organic compound emissions as compared to liquid paint, collection and recycle systems for powder paint are complex and expensive. Therefore, it would be very desirable to reduce overspray of powder paint or increase deposition efficiency. It is a primary object of the present invention to improve the deposition efficiency of rotary atomizers for powder paint.

SUMMARY OF THE INVENTION

The atomizer for powder paint of this invention includes a rotary bell element comprising a generally axial paint tube, a deflector or diverter having a distribution surface opposed to the outlet of the paint tube directing the paint radially and axially toward an overflow surface through an annular channel, an annular electrostatically charged surface adjacent an end surface of the bell element generating an annular electrostatic field electrostatically charging the paint, and an axially extending electrostatically charged electrode having a distal end preferably in the plane of the annular electrostatically charged surface generating an axial electrostatic field of generally the same charge as the annular electrostatic field. It has been found by the applicant that a central axial electrostatic field of substantially the same charge as the annular electrostatic field extending from adjacent the edge of the bell element results in an improvement in deposition efficiency of about eight percent, which thus significantly reduces overspray. This improvement is of particular importance for the color coats which presently cannot be recycled except as a basecoat.

In the most preferred embodiment, the bell element includes a nonconductive end face preferably formed of a polymer having a low coefficient of friction, such as polytetraflouroethylene or Teflon®. The end face includes a depression surrounding the center electrode and a planar surface surrounding the central depression having a circular outer edge adjacent the paint overflow surface. The annular electrostatically charged surface which generates the annular electric field is preferably adjacent to and surrounds the circular outer edge of the nonconductive end face and most preferably the end face is integrally formed with the deflector or diverter. In the preferred embodiment, the distribution surface of the deflector includes a generally cone-shaped deflector tip having a concave exterior surface which directs the paint into a cone-shaped annular channel or passage defined by opposed conical surfaces, wherein a distal end of one of the conical surfaces defines the annular electrostatically charged surface generating the annular electrostatic field. In the disclosed embodiment, one of the conical surfaces which define the annular conical channel is continuous with the generally conical surface of the deflector and this surface extends to and supports the circular outer edge of the end face. In this embodiment, the distal annular edge provides the annular electrostatically charged surface which is coplanar with the planar surface of the nonconductive end face. Alternatively, the opposed conical surface may extend to the plane of the end face, wherein the distal outer edge provides the annular electrostatically charged surface.

In the most preferred embodiment, the paint tube is connected to the bearing of the atomizer and electrostatically charged. In this embodiment, the paint tube is electrically connected to both the annular electrostatically charged surface and the center electrode, such that the central electrode and the annular electrostatically charged surface are at the same electrical potential and generate electrostatic fields having substantially the same charge. In the disclosed embodiment, the paint tube is connected to a source of electric current and the center electrode is electrically connected to the paint tube by a tubular ring which surrounds the deflector.

As set forth above, the atomizer having a rotary bell element of this invention results in an improved deposition efficiency of about eight percent as compared to a bell element of essentially the same design without a center electrode as described above. Other advantages and meritorious features of the present invention will be more fully understood from the following description of the preferred embodiments, the appended claims and the drawings, a brief description of which follows.

DETAILED DESCRIPTION OF THE PREFERRED EMBODIMENTS

Figure 1:
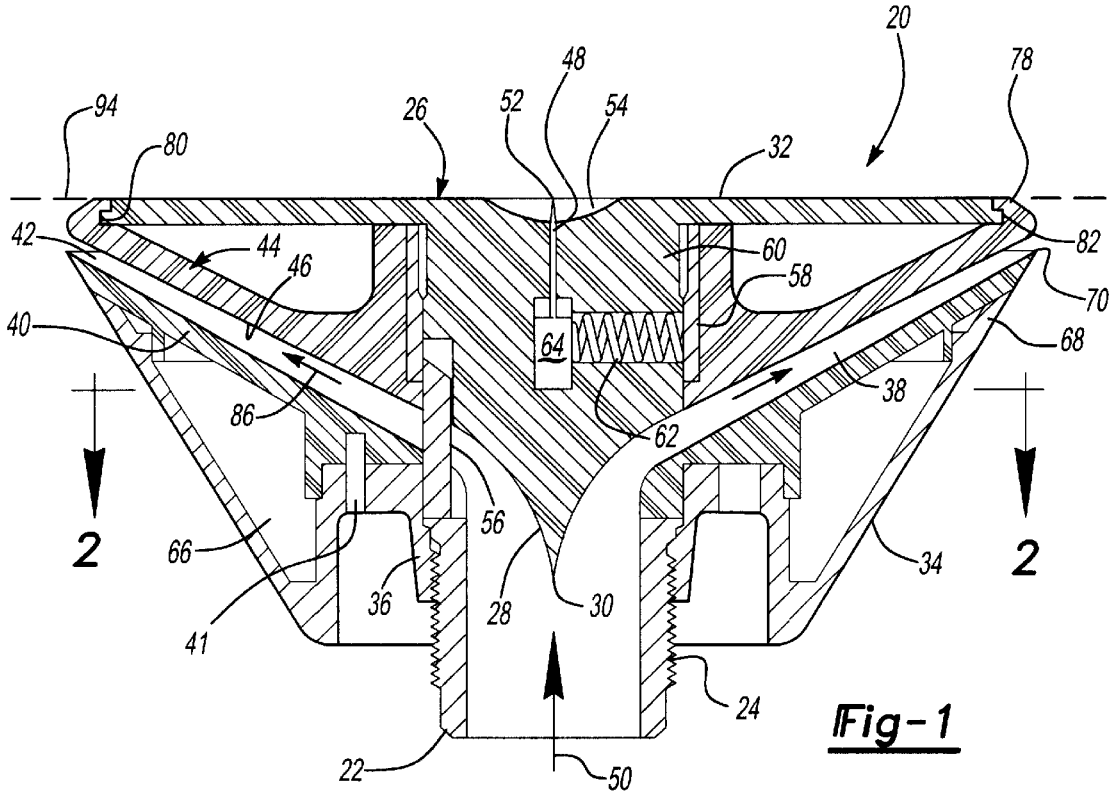
FIG. 1 is a side cross-sectional view of one preferred embodiment of a rotary bell element for an atomizer of this invention.
Figure 2:
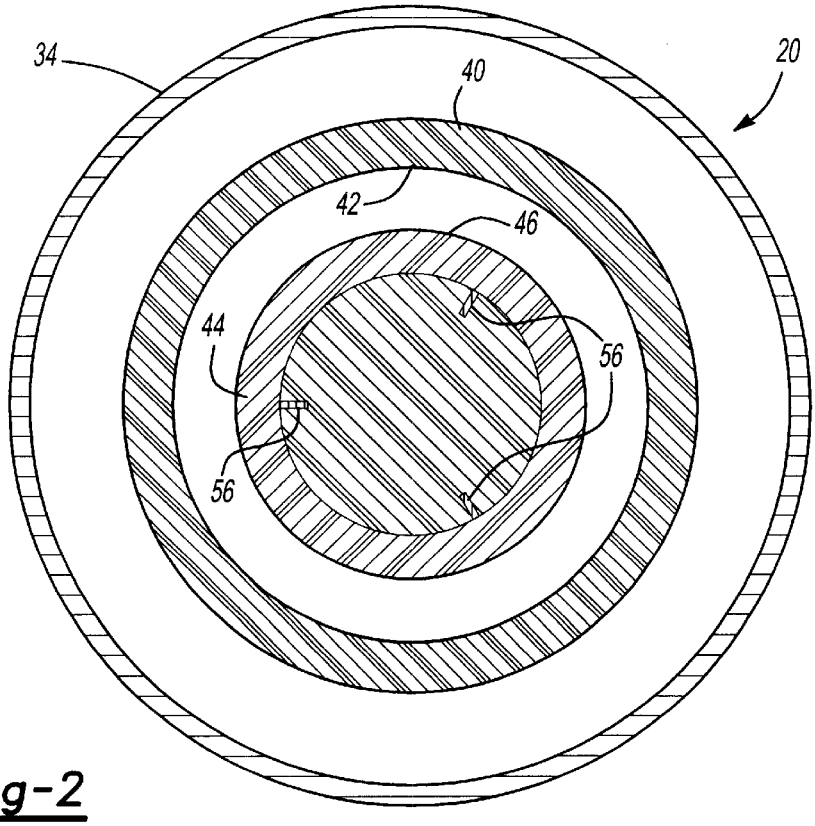
FIG. 2 is an end cross-sectional view of FIG. 1 in the direction of view arrows 2—2.

The rotary bell element or bell cup 20 for a rotary atomizer illustrated in FIGS. 1 to 3 includes a paint tube 22 which is externally threaded at 24 to be threadably received on the rotary bearing of a rotary atomizer (shown in FIG. 4 at 72) and is electrically connected to the atomizer to electrostatically charge paint sprayed by the rotary bell as described below. The rotary bell element 20 further includes a deflector or diverter 26 which, in the disclosed embodiment, includes a generally conical concave distribution surface 28 having a deflection tip 30 which is opposed to and extends into the outlet of the paint tube 22 as shown in FIG. 1. In this embodiment, the distribution surface 28 of the deflector 26 is integrally formed with a non-conductive end surface or plate 32 preferably formed of a polymer having a local efficient of friction, such as polytetrafluoroethylene, or Teflon® The rotary bell element 20 further includes a rear housing 34 which, in the disclosed embodiment, includes a female threaded portion 36 which is threadably supported on the threaded portion 24 of the paint tube 22. Paint entering the paint tube 22 is received by the generally conical distribution surface 28 and directed radially and axially into an annular generally conical passage or channel 38 which is defined by a rear distribution member 40 having a conical surface 42 and a front distribution member 44 having an opposed conical surface 46. The rear distribution member 40 is connected to the rear housing member 34 by fasteners, such as rivets 41 or made integral with the rear housing member. The rotary bell element 20 of this invention further includes a central electrode having a relatively sharp tip portion 52 extending in the axis 50 of the rotary bell element as shown in FIG. 1. The tip portion 52 of the axial electrode preferably has a diameter of between 0.2 to 1 mm, more preferably between 0.3 to 0.6 mm or most preferably about 0.5 mm. The tip portion 52 of the central electrode extends through a bowl-shaped depression 54 in the end face 32. In the preferred embodiment, the bowl-shaped depression 54 is shallow, arcuate and concentric relative to the axis 50 of the rotary bell element and the tip portion 52 of the central electrode.

Figure 3:
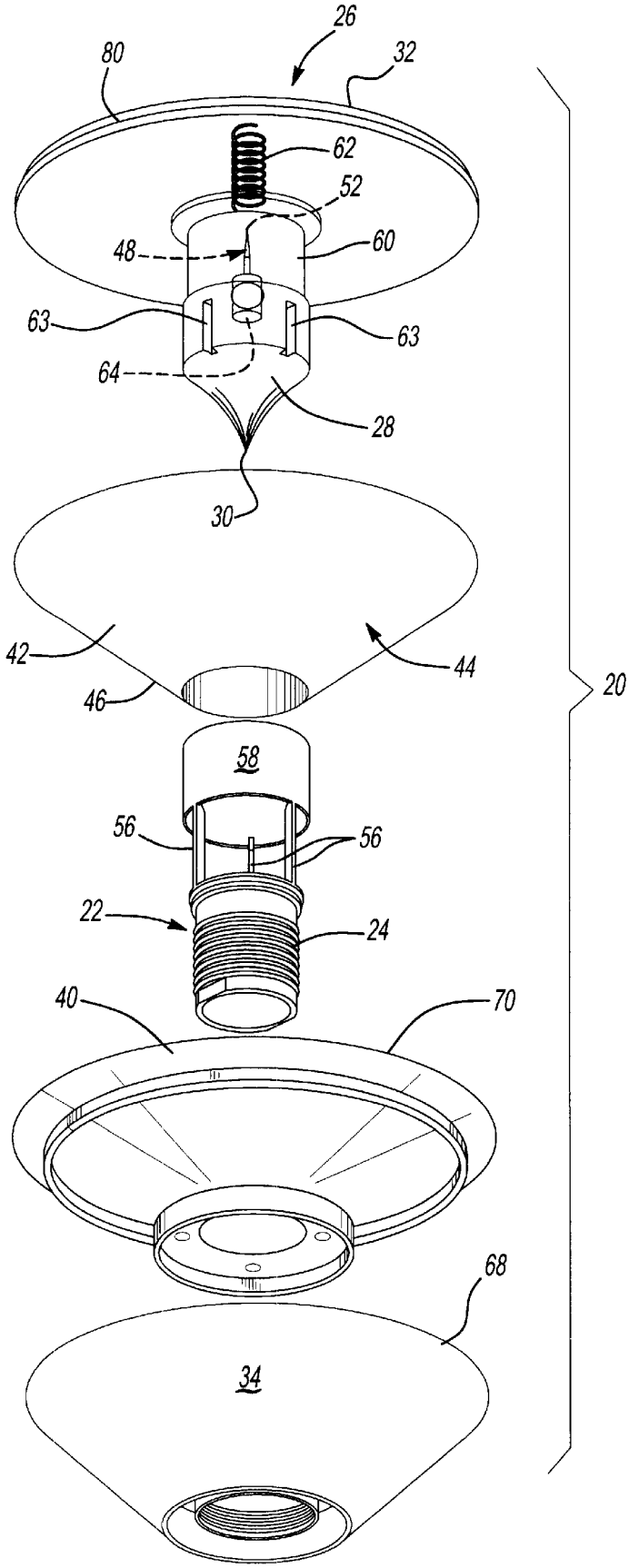
FIG. 3 is an exploded view of the rotary bell element illustrated in FIG. 1.

As best shown in FIG. 3, the paint tube 22 includes a plurality of radially spaced axial conductive pins 56 which are connected to a conductive tubular element 58 by suitable means including soldering or screws. The conductive tubular element 58 surrounds the body 60 of the non-conductive deflector 26 and a conductive coil spring 62 electrically connects the body 64 of the center electrode to the inlet tube 22 as best shown in FIG. 1. In the disclosed embodiment, the body 60 of the diverter 26 has an enlarged cylindrical portion having axial grooves or notches 63 which receive the conductive pins 56 as shown in FIG. 3. This construction also prevents relative rotation of the paint tube 22 and the diverter or deflector 26. In the disclosed embodiment, the conductive pins 56 are generally rectangular in cross-section and extend through the annular passage 38 which receives powder paint. The applicant is presently experimenting with alternative designs to reduce accumulation of paint on the pins 56, including pins having a knife-edge facing the flow of paint and enclosing the pins in Teflon® tubes (not shown). In the disclosed embodiment, the rear housing element 34, which may be formed of aluminum, for example, includes an annular chamber 66 to reduce weight and a distal annular end portion 68 which supports the distal annular end portion 68 of the rear distribution member 40 as shown in FIG. 1.

Figure 4:
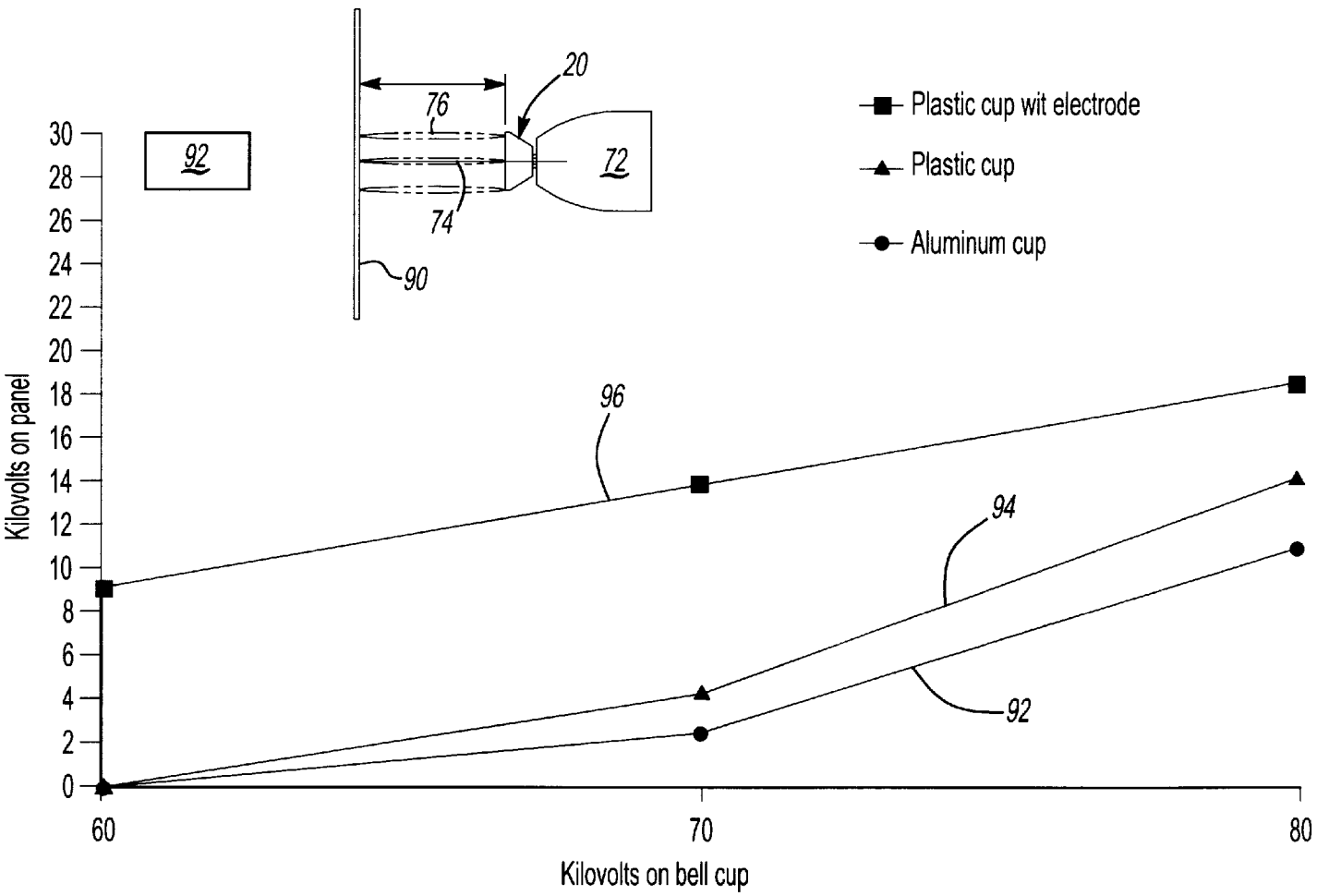
FIG. 4 is a graphical illustration of tests conducted by the applicant comparing different rotary bell elements.

As set forth above, the paint tube 22 is threadably connected to the rotary bearing of the atomizer 72 shown in FIG. 4 and the rotary bearing is connected to a source of electric current (not shown) which typically impresses a voltage of between 50 to 90 KV on the paint tube 22. As set forth above, the central axially extending electrode 48 is electrically connected to the paint tube 22 and thus the tip portion 52 of the central electrode is electrostatically charged to generate a central axially extending electrostatic field 74 as shown in FIG. 4. Further, the rotary bell element includes an annular electrostatically charged surface adjacent the end surface of the bell element which generates an annular electrostatic field 76 as now described. As will be understood by those skilled in this art, the annular electrostatically charged surface of the bell element 20 may be selected from the annular distal end 70 of the rear distribution member 40, wherein the rear housing 34 may be formed integrally with the rear distribution member 40. However, in the preferred embodiment, both the rear and front distribution members 40 and 44, respectively, are formed of a conductive polymer, such as polytetrafluoroethylene, having a conductive filler and the annular distal end portion 78 is electrostatically charged by the tubular portion 58 of the paint tube 22 and which is closest to the workpiece generates the annular electrostatic field 76 shown in FIG. 4. In the most preferred embodiment, the annular surface 78 is essentially co-planar with the planar surface of the end face 32 as shown in FIG. 1. Further, in this embodiment, the annular distal end 78 includes an annual groove 80 which receives an annular lip 82 of the end face 32, supporting the circular radial outer edge of the end face 32 as shown in FIG. 1.

As will now be understood, paint enters the paint tube 22 as shown in FIG. 1 by arrow 84 from the atomizer 72 shown in FIG. 4 and the paint is received by the opposed conical surface of the deflector or divertor 26. The conical surface 28 directs the paint radially and axially through the annular conical channel or passage 38 as shown by arrows 86, which directs the paint to the paint overflow surface 70. The paint is electrostatically charged as it flows through the channel 38 by the opposed electrostatically charged surfaces 42 and 46. The electrostatically charged powder paint is then "atomized" by the centrifugal force of the rapidly rotating atomizer bell, as described above, and the powder is directed to the work surface by the annular electrostatic field 76 as shown in FIG. 4.

As set forth above, the central axial electrostatic field 74 generated by the axial needle 52 of the electrode 48 results in a significant improvement in the deposition efficiency of the rotary atomizer. This improvement in efficiency is illustrated in the graph of FIG. 4. FIG. 4 graphically illustrates the improvement in deposition efficiency resulting from the axial electrostatic field 74 generated by the central electrode 48. The test typically conducted by the paint industry for deposition efficiency compares the voltage generated in a panel 90 by the electrostatic field generated by the atomizer 72. The voltage is measured by a meter 92. That is, the greater the voltage generated in the panel by the electrostatic field, the greater the deposition efficiency. FIG. 4 is thus a graph comparing a conventional bell element having an aluminum cup 92, a bell element having a plastic cup of the design shown in FIG. 1 without the axial electrode and the bell element shown in FIGS. 1 to 3 having an axial electrode 96. As shown in FIG. 4, the rotary bell element 20 of this invention has a significantly improved deposition efficiency which was also confirmed by experimental testing. Experimental testing also established that in the most preferred embodiment the distal sharp end 52 of the central electrode lies essentially in the same plane 94 as the annular electrostatic surface 78 shown in FIG. 1 which generates the annular electrostatic field 76 as shown in FIG. 4. Because the annular surface 78 and the central electrode 48 are at the same electrical potential because they are both electrically connected to the paint tube 22, the central electrostatic field 74 has the same voltage as the annular electrostatic field 76. Based upon prototype testing, it is believed that generating a central or axial electrostatic field having substantially the same voltage as the annular electrostatic field is an important feature of this invention.

As will be understood by those skilled in this art, various modifications may be made to the rotary bell element of this invention within the purview of the appended claims. For example, the annular electrostatic surface 78 may be recessed from the plane 94 of the planar end face 32, in which case the distal end of the sharp axial electrode should also be recessed to generate essentially the same voltage in the electrostatic field. Having described a preferred embodiment of the rotary bell element or bell cup of this invention, the invention is now claimed as follows.

What is claimed is:

1. An atomizer for powder paint including a rotary bell element, comprising:

a nonconductive end face;

a generally axial paint tube;

a deflector having a distribution surface opposed to said paint tube directing paint radially and axially toward an overflow surface through an annular channel having opposed paint distribution surfaces;

an annular electrostatically charged surface surrounding said nonconductive end face adjacent said end face of said bell element generating an annular electrostatic field; and an axially extending central electrostatically charged electrode having a distal end generally in the plane of said annular electrostatically charged surface generating an axial electrostatic field of generally the same charge as said annular electrostatic field.

2. The atomizer as defined in claim 1, wherein said nonconductive end face includes a depression surrounding said axially extending central electrode.

3. The atomizer as defined in claim 2, wherein said depression is bowl-shaped.

4. The atomizer as defined in claim 1, wherein said opposed paint distribution surfaces are electrically charged and one of said surfaces includes said annular electrically charged surface at a distal end thereof.

5. The atomizer as defined in claim 1, wherein said annular electrostatically charged surface is generally coplanar with said nonconductive end face.

6. The atomizer as defined in claim 5, wherein said annular electrostatically charged surface supports an outer radial edge of said nonconductive end face.

7. The atomizer as defined in claim 1, wherein said deflection surface of said deflector is generally cone-shaped directing paint radially and axially and said annular channel is generally cone-shaped and said deflector includes a nonconductive end face portion surrounding said axially extending central electrode.

8. The atomizer as defined in claim 7, wherein said opposed paint distribution surfaces are electrically charged and said axially extending electrode is at substantially the same electrical potential as said opposed paint distribution surfaces.

9. The atomizer as defined in claim 1, wherein said paint inlet tube is electrically charged and said axially extending central electrode and said annular electrostatically charged surface are electrically connected to said paint inlet tube having the same electrical potential.

10. An atomizer for powder paint including a rotary bell element comprising:

a nonconductive end face having a generally circular outer edge;

an axial paint tube extending toward and generally perpendicular to said nonconductive end face;

a deflector having a paint distribution surface opposing an outlet of said paint tube directing paint into an annular generally conical passage to an overflow surface adjacent said outer edge of said nonconductive end face;

an annular electrostatically charged surface adjacent said outer edge of said nonconductive end face generating an annular electrostatic field surrounding said nonconductive end face; and a central electrode extending axially through said nonconductive end face electrostatically charged at substantially the same electrical potential as said annular electrostatically charged surface having a distal end generally in the plane of said annular electrostatically charged surface and generating an axially extending center electrostatic field increasing the deposition efficiency of said atomizer.

11. The atomizer as defined in claim 10, wherein said paint tube is operably connected to a source of electric current and said central electrode and said annular electrostatically charged surface are electrically connected to said paint inlet tube.

12. The atomizer as defined in claim 11, wherein said deflector and said nonconductive end face are integrally formed from a nonconductive polymer and said paint tube including a ring-shaped portion surrounding said deflector and electrically connected to said annular electrostatically charged surface and said central electrode.

13. The atomizer as defined in claim 12, wherein said generally conical passage is defined by opposed electrostatically charged conductive distribution surfaces and said annular electrostatically charged surface is defined by a distal end surface of one of said electrostatically charged distribution surfaces.

14. The atomizer as defined in claim 12, wherein said nonconductive end face is generally planar having a depression surrounding said axially extending central electrode.

15. The atomizer as defined in claim 14, wherein said depression is bowl-shaped having an arcuate surface surrounding said central electrode.

16. The atomizer as defined in claim 12, wherein said central electrode extending through said nonconductive end face is a sharp needle having a diameter less than 1 mm.

17. The atomizer as defined in claim 10, wherein said deflection surface of said deflector is generally cone-shaped having a deflection tip extending into said axial paint tube and said distribution surface comprises a concave conical surface directing paint into said annular generally conical passage.

18. The atomizer as defined in claim 17, wherein said deflector is formed of a nonconductive polymer.

19. The atomizer as defined in claim 10, wherein said annular generally conical passage is defined by opposed electrostatically charged conical surfaces including a surface generally continuous with said paint distribution surface of said deflector having a distal annular end surface defining said annular electrostatically charged surface surrounding said nonconductive end face.

20. The atomizer as defined in claim 19, wherein said distal annular end surface supports said generally circular outer edge of said nonconductive end face.

21. An atomizer for powder paint including a rotary bell element, comprising:

a nonconductive end face having a central depression, a planar surface surrounding said depression and a circular outer edge;

an axial paint tube extending toward and generally perpendicular to said planar surface of said nonconductive end face having an outlet;

a deflector having a generally conical paint distribution surface opposing said outlet of said paint tube directing paint through an annular passage to a paint overflow surface adjacent said outer edge of said nonconductive end face;

an annular electrostatically charged surface adjacent said outer edge of said nonconductive end face generating an annular electrostatic field surrounding said nonconductive end face; and a central electrode having a sharp distal end extending through said central depression of said nonconductive end face substantially in the plane of said planar surface of said nonconductive end face electrostatically charged at substantially the same electrical potential as said annular electrostatically charged surface generating an axially extending electrostatic field increasing the deposition efficiency of said atomizer.

22. The atomizer as defined in claim 21, wherein said generally conical paint distribution surface of said deflector includes a tip portion extending into said axial paint tube and said generally conical paint distribution surface is concave.

23. The atomizer as defined in claim 22, wherein said deflector and said nonconductive end face are integrally formed from a nonconductive polymer.

24. The atomizer as defined in claim 21, wherein said annular passage is defined by opposed electrically charged conical surfaces including a surface generally continuous with said generally conical paint distribution surface of said deflector having a distal annular end surface defining said annular electrically charged surface surrounding said generally circular outer edge of said nonconductive end face.

25. The atomizer as defined in claim 24, wherein said distal annular end surface is generally coplanar with said planar surface of said nonconductive end face and support said generally circular outer edge.

26. The atomizer as defined in claim 21, wherein said depression is a shallow bowl shape concentrically surrounding said sharp distal end of said central electrode.

* * * * *

UNITED STATES PATENT AND TRADEMARK OFFICE

CERTIFICATE OF CORRECTION

PATENT NO. : 6,578,779 B2
DATED : June 17, 2003
INVENTOR(S) : Mark E. Dion

It is certified that error appears in the above-identified patent and that said Letters Patent is hereby corrected as shown below:

Column 6,
Lines 48, 54 and 60, delete “12” and insert -- 10 --.

Signed and Sealed this

Twenty-fifth Day of November, 2003

JAMES E. ROGAN
*Director of the United States Patent and Trademark Office*